US005336336A

United States Patent [19]

Matsuda

[11] Patent Number: 5,336,336

[45] Date of Patent: Aug. 9, 1994

[54] PROCESS FOR CHEMICAL TREATMENT WITH PHOSPHATE

[75] Inventor: Shigeki Matsuda, Okazaki, Japan

[73] Assignee: Nippondenso Co., Ltd., Kariya, Japan

[21] Appl. No.: 875,804

[22] Filed: Apr. 30, 1992

[30] Foreign Application Priority Data

May 1, 1991 [JP] Japan ..... 3-100138

[51] Int. Cl.[5] ..... C23C 22/86

[52] U.S. Cl. ..... 148/240; 148/270

[58] Field of Search ..... 148/240, 270, 271; 266/227, 229

[56] References Cited

FOREIGN PATENT DOCUMENTS

| | | |
|---|---|---|
| 0162345 | 11/1985 | European Pat. Off. . |
| 0109871 | 9/1978 | Japan . |
| 60-43491 | 3/1985 | Japan . |
| 60-238486 | 11/1985 | Japan . |
| 63-270478 | 11/1988 | Japan . |
| 0606381 | 10/1948 | United Kingdom . |

OTHER PUBLICATIONS

*The Condensed Chemical Dictionary,* 3rd Ed. pp. 232–233 Jun. 2, 1944.

Patent Abstracts of Japan, vol. 21, No. 44 (C-29), 30 Nov. 1978.

Patent Abstracts of Japan, vol. 10, No. 239 (C-367) (2295) 19 Aug. 1986.

*Primary Examiner*—Scott Kastler

*Attorney, Agent, or Firm*—Cushman, Darby & Cushman

[57] ABSTRACT

A process for a chemical treatment with a phosphate by bringing a steel material into contact with a phosphate chemical treatment bath maintained at 40° C. or less and containing a phosphate ion, a nitrate ion, a chemical film formable metal ion and an oxidizing agent, to cause a film formation reaction between the phosphate chemical treatment bath and the steel material, whereby a phosphate chemical film is formed on the surface of the steel, wherein a circulation path for withdrawing a portion of the phosphate chemical treatment bath and returning the withdrawn phosphate chemical treatment bath to the bath is provided, and a filter comprising an inorganic material composed of $SiO_2$ and $Al_2O_3$ is provided in the circulation path, of which filter not only enables sludge from the phosphate chemical treating solution to be physically removed but also prevents changes the chemical structure in the form of a solution.

15 Claims, 5 Drawing Sheets

PROCESS FOR CHEMICAL TREATMENT WITH PHOSPHATE

BACKGROUND OF THE INVENTION

1. Field of the Invention

The present invention relates to a process for a chemical treatment with a phosphate, and more specifically, it relates to a process for chemical treatment by which a strong chemical film can be formed on the surface of a steel material at room temperature (or ordinary temperature).

2. Description of the Related Art

Examples of the process for a chemical treatment with a phosphate known in the art, wherein the treatment is carried out at room temperature of 40° C. or less, include processes described in Japanese Unexamined Patent Publication (Kokai) Nos. 54-270478, 60-43491, 60-238486 and 63-270478.

In the process described in Japanese Unexamined Patent Publication (Kokai) No. 54-270478, the molar ratio of the phosphate ion to the metallic (zinc) ion in the treatment bath is maintained in the range of from 0.5 to 3.7, to smoothly effect a phosphate treatment at room temperature. In the process described in Japanese Unexamined Patent Publication (Kokai) No. 60-43491, the chemical treatment at room temperature becomes possible by specifying the range of the pH and the redox potential (ORP) respectively in certain ranges. In the process described in Japanese Unexamined Patent Publication (Kokai) No. 60-238486, the method of adding a nitrite ion is improved, and the nitrite ion is supplied to the treatment bath separately from a main agent to avoid the occurrence of a vigorous reaction between the nitrite ion and the main agent. In the process described in Japanese Unexamined Patent Publication (Kokai) No. 63-270478, the phosphate ion concentration (g/liter) of the phosphate chemical treatment bath composition is made lower than the active anion concentration (g/liter) to accelerate the formation of the chemical film by an immersion method at room temperature.

The phosphate chemical treatment is a process that makes the film on the surface of a metal substrate, by using the reaction between chemical agents and the metal substrate in the aqueous bath. An aqueous phosphate solution bath containing a film formable metallic ion, such as iron, manganese or zinc.

The phosphate chemical treatment process can be considered as comprising a step of etching a metal material and a step of forming a film.

The etching reaction is mainly composed of a reduction reaction of a nitrate ion or other ion as a cathode reaction, for example, $$NO_3^- + 2H^+ + 2e \rightarrow NO_2^- + H_2O \text{ (endothermic reaction)} \quad (1)$$

and a metal dissolution reaction as an anode reaction, for example, $$Fe \rightarrow Fe^{2+} + 2e \text{ (exothermic reaction)} \quad (2)$$

The filming formation reaction is mainly composed of a reduction reaction (as a cathode reaction) of a nitrite ion or other ion formed by the above-mentioned etching reaction, for example, $$NO_2^- + 2H^{30} + e \rightarrow NO + H_2O \text{ (endothermic reaction)} \quad (3)$$

and a dehydrogenation reaction (as an anode reaction) of a phosphate ion with a metal ion, for example, $$(Zn^{2+}, Fe^{2+}) + 2H_2PO_4^- \rightarrow (Zn, Fe)_3(PO_4)_2 + 4H^+ \text{ (exothermic reaction)} \quad (4)$$

Further, in addition to the above-mentioned reactions represented by the formulae (1) to (4), the following balance retaining reactions exist in the chemical treatment bath.

$$H_3OP_4 \longleftrightarrow H_2PO_4^- + H^+ \quad (5)$$

$$4OH^- \rightarrow O_2 + 2H_2O + 4e \quad (6)$$

$$NO_3^- + 2H^+ + 2e \longleftrightarrow NO_2^- + H_2O \quad (7)$$

In the phosphate chemical treatment process according to the present invention also, a phosphate film is basically formed on the surface of the steel according to the above-mentioned reaction.

The present inventors have investigated sludge generated in the chemical treatment bath in the phosphate chemical treatment process. In the phosphate chemical treatment process, the presence of sludge in the chemical treatment bath has been unavoidable in a room temperature treatment process, and in the high temperature heating process currently widely used in the art.

Specifically, the sludge included in the chemical treatment bath is that wherein the phosphate formed according to the above-mentioned formulae (1) to (4) does not precipitate on the surface of the steel, but forms a colloid, and further, a solid particle in the chemical treatment bath.

The sludge in the phosphate chemical treatment bath participates in the reaction represented by the formula (4) and make lower the quality of the chemical film by mixing with the film.

The formation of sludge in the phosphate chemical treatment bath means that the chemical film formable substance dissolved in the chemical treatment bath is consumed (or solidified) as sludge.

Because the sludge becomes large and grows with the lapse of time, the presence of sludge in the treatment bath, as such, serves to convert the dissolved chemical film formable ion to sludge. Specifically, the formation of sludge causes the amount of chemical film formable ion in the chemical treatment bath to be reduced and promotes the reduction in the amount of the chemical film formable ion. This causes a problem that the capability of the chemical treatment bath to form a chemical film is lowered by the reduction in the amount of the chemical film formable ion.

Further, the electro-chemical parameter controlling of the bath is hindered by the sludge existence. The formation of the sludge means that not only an originally necessary reaction system involved in the formation of the film, but also an unnecessary reaction system involved in the formation of sludge are present in the chemical treatment bath. Therefore, a state such that the sludge formation reaction is not controlled cannot be considered one in which the reaction in the chemical treatment bath is precisely controlled, and thus it cannot be considered that the film formation reaction is precisely controlled. This corresponds to that in the heat treatment process, since components of the treatment bath are always subjected to decomposition by heating to form sludge, and thus it is difficult to control the reaction in the chemical treatment bath.

Thus, in the conventional phosphate chemical treatment bath, although the necessity of a control of the amount of the sludge has been recognized, there exists no method for precisely controlling the formation of sludge.

Examples of the conventional method of controlling the amount of sludge include a method wherein the whole bath solution containing sludge withdrawn to hold in a settling tank at suitable intervals, to separate and remove the sludge, and a method wherein a liquid (or a slurry) containing sludge separated and settled at the bottom inside of the treatment bath is continually or periodically withdrawn by a pump or the like, and filtered to separate and remove the sludge. In the heating bath, however, since a large amount of sludge is formed, it is impossible to remove all of the sludge in the chemical treatment bath, so that this method is not adequate for practical use as a method of removing sludge. Further, in these methods, also in the case of a bath at room temperature, the amount of sludge cannot be sufficiently reduced.

Thus, there exists no method by which the sludge can be completely removed for a practical use.

SUMMARY OF THE INVENTION

Accordingly, an object of the present invention is to eliminate the above-mentioned disadvantages of the prior art and to develop a process for chemical treatment with a phosphate which is free from the occurrence of sludge in a solid particulate form and provides a high-quality chemical coating.

Other objects and advantages of the present invention will be apparent from the following description.

In accordance with the present invention (i.e., the first invention), there is provided a process for chemically treating a surface of a steel material with a phosphate comprising the step of bringing the steel material into contact with a phosphate chemical treatment bath maintained at 40° C. or less and containing a phosphate ion, a nitrate ion, a chemical film forming metal ion and an oxidizing agent to cause a film forming reaction between the phosphate chemical treatment bath and the steel material, whereby a phosphate chemical film is formed on the surface of the steel, wherein a circulating path for withdrawing a portion of the phosphate chemical treatment bath and returning the withdrawn phosphate chemical treatment bath to the bath is provided, and a filter comprising an inorganic material composed mainly of $SiO_2$ and $Al_2O_3$ is provided in the circulating path.

In accordance with the present invention (i.e., the second invention), there is also provided a process for chemically treating a surface of a steel material with a phosphate comprising the step of bringing the steel material into contact with a phosphate chemical treatment bath containing a phosphate ion, a nitrate ion, a chemical film formable metal ion and an oxidizing agent to cause a film forming reaction between the phosphate chemical treatment bath and the steel material, whereby a phosphate chemical film is formed on the surface of the steel, wherein a portion of the phosphate chemical treatment bath is withdrawn from a vessel, containing the phosphate chemical treatment bath, in which the film formation reaction occurs, an energy state, as a liquid, is stabilized by a thermodynamic-energy stabilizing means, and the phosphate chemical treatment bath is returned to the bath vessel.

In accordance with the present invention (i.e., the third invention), there is further provided a process for chemically treating a surface of a steel material with a phosphate comprising the step of bringing the steel material into contact with a phosphate chemical treatment bath containing a phosphate ion, a nitrate ion, a chemical coating formable metal ion and an oxidizing agent to form a phosphate chemical film on the surface of the steel, wherein a portion of the phosphate chemical treatment bath is withdrawn from a vessel containing the phosphate chemical treatment bath into which a steel material is immersed, the phosphate chemical treatment bath is passed through a filtering medium comprising a porous inorganic material composed mainly of $SiO_2$ and $Al_2O_3$, and the phosphate chemical treatment bath is returned to the bath vessel.

BRIEF DESCRIPTION OF THE DRAWINGS

The present invention will be better understood from the description set forth below with reference to the accompanying drawings, wherein.

DESCRIPTION OF THE PREFERRED EMBODIMENTS

The present inventors have made extensive and intensive studies with a view to developing a process for a chemical treatment with a phosphate at room temperature, and as a result, have found for the first time that the prevention of the formation of the sludge in the chemical treatment bath is effected by not only a physical means, but also a chemical means.

First, the reason why the first to third inventions can sufficiently prevent the formation of sludge will now be described from the thermodynamic viewpoint.

The formation and growth of sludge in the chemical treatment bath can be considered as the formation and growth of crystal nuclei in the solution.

Namely, from the thermodynamic viewpoint, the formation of crystal nuclei in the solution is considered to be attributable to the fact that, since the chemical treatment bath which enables a film to be formed is in a supersaturated state, the energy becomes more stable when the supersaturated component is precipitated to solid than when the entire bath is liquid.

This will now be described in more detail. In general, the amount of energy-change of the formation and growth of crystal nuclei which cause the formation of sludge, $\Delta G$, can be expressed by the sum of the volumetric energy, $\Delta GV$, which reduces free energy of a solution phase (liquid) per se by the formation of the crystal nuclei and the amount of change of surface energy, ΔGS, accompanying a change in the degree of free energy of the solution produced by the formation of a new surface on the boundary of the crystal nuclei and the solution phase.

$$\Delta G = \Delta GV + \Delta GS = -4/3\pi r^3 \Delta\mu + 4\pi r^2 \gamma \quad (8)$$

wherein r is a radius of crystal nucleus, $\Delta\mu$ is a degree of supersaturation, and $\gamma$ is a surface energy density.

Figure 1:
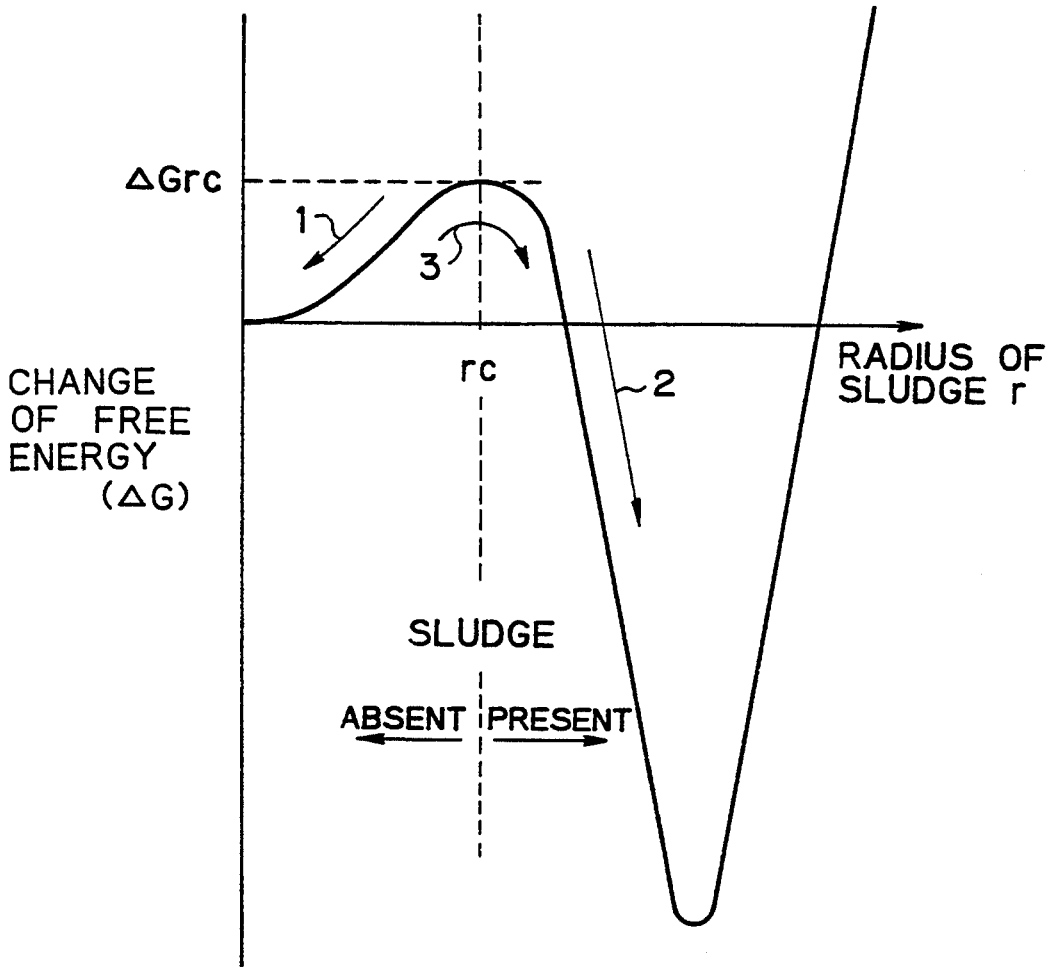
FIG. 1 is a diagram showing the relationship between the particle diameter of sludge in the chemical treatment bath and the change of free energy ($\Delta G$)

A model of a mechanism on the formation and growth of crystal nucleus in the solution according to the above formula (8) is shown in FIG. 1.

As apparent from FIG. 1, no sludge forms in crystal nuclei having a radius smaller than a critical nucleus represented by a radius of critical nucleus (rc), as indicated by an arrow 1. When the radius of the crystal nucleus exceeds the radius of a critical nucleus of sludge indicated by (rc) in FIG. 1, the free energy (ΔGrc) becomes negative, so that sludge grows as indicated by an arrow 2. When a large external energy is added to a transparent chemical treatment bath by heating, dissolution of iron or the like, an energy exceeding ΔGrc is added to the soluble component in the chemical treatment bath, and the free energy (ΔG) of the treatment bath is remarkably reduced by the supply of this energy. In the chemical treatment bath, the crystal precipitates and grows to a radius exceeding the critical nucleus radius (rc), according to an arrow indicated by reference numeral 3, so that the precipitation of sludge in the treatment bath and the formation of film on the surface of steel occur.

When iron is dissolved, an energy (ΔH) accompanying the dissolution of iron is applied to the chemical treatment bath. This causes the crystal to be precipitated and grown to form a film on the steel surface.

Thus, in order to maintain the chemical treatment bath in a transparent state free from sludge, it is necessary to maintain the radius of crystal nucleus of sludge in the chemical treatment bath in a smaller region than (rc) in FIG. 1, and accordingly, the following means is considered.

(1) A method wherein sludge in the chemical treatment bath is physically removed by filtration.

In this case, various filtration methods known in the art may be used.

The removal of the sludge can be intermittently or continuously carried out.

(2) A method wherein the application of energy to the chemical treatment bath is suppressed.

Specifically, when an external energy is excessively added to the chemical treatment bath, for example, when the chemical treatment bath is pressurized to a great extent by a filtration pump, the application of the energy causes the internal energy (ΔH) of the chemical treatment bath to be reduced, so that the free energy, G, is remarkably reduced. So the sludge is formed in the bath.

Specific examples of the method of suppressing the application of energy to the chemical treatment bath include means such as an avoidance of an excessive stirring of the chemical treatment bath, avoidance of an excessive increase in the temperature of the chemical treatment bath, avoidance of local heating, suppressing of a filtration pump rotation, a lowering of the filtration pressure. Specifically, it is preferred to control the filtration pump rotation to moderately conduct the operation with a pressure loss in the filtration path of preferably 1.0 kg/cm$^2$ or less, more preferably 0.6 kg/cm$^2$ or less.

Although the use of the above-mentioned means enables the formation of sludge to be prevented to some extent, the prevention is not satisfactory. The present inventors have found, for the first time, through the study of mechanism of the formation of the sludge that the formation of sludge in the chemical treatment bath can be prevented by chemically reducing the internal energy as a liquid of the chemical treatment bath through the circulation of the chemical treatment bath, by using a specified filtration medium in continuous filtration.

As mentioned above in connection with the formula (8), the transparent chemical treatment bath according to the present invention can be defined as a reaction solution having an excessive chemical potential called a "supersaturated state". In this state, the application of a slight external energy causes sludge to be formed.

In the chemical treatment bath in such a state, the precipitation of the crystal accompanying the formation of a chemical film is conducted on the whole surface of the material to be treated according to the formula (4). At the same time, in the entire bath, reactions represented by the formulae (1) to (4) occur. These reactions cause the liquid-chemical structure of components constituting the chemical treatment bath to be changed. That is, a mutual balance of energy among a metallic ion, a phosphate ion and a nitrate ion are confused or effected, so that the structure becomes unstable. The repetition of the reactions represented by the formulae (1) to (4) causes the chemical structure of individual components of the chemical treatment bath to be gradually changed, which breaks the energy balance. Consequently, the free energy level accumulating in the bath, shown in FIG. 1 approaches ΔGrc, and finally, exceeds this value, and as a result, the formation of sludge occurs in the chemical treatment bath.

The present inventors have found that the formation of sludge of the chemical treatment bath can be chemically prevented by not only the prevention of the change in the chemical structure of individual components in a liquid state of the chemical treatment bath but also the stabilization of the chemical structure.

Specifically, they have found that a continuous contact filtration of the chemical treatment bath through porous inorganic materials, such as $SiO_2$ and $Al_2O_3$, while maintaining a state such that no external energy such as pressure adding is applied, enables to suppress of change in the structure of the solution, and at the same time, to be stabilized, so that the chemical treatment bath can be always maintained transparent.

When such means are used, for example, interactions, such as a solution chemically electrostatic mutual interaction and a polarization mutual interaction, effect between the solution containing a metallic ion, a phosphate ion, a nitrate ion, etc., in the chemical treatment bath and the surface of porous $SiO_2$, $Al_2O_3$, etc., and a giving and taking of energy occur. The giving and taking of the energy enable an unstable energy state in the solution caused by a very small soluble ion chemical-structural distortion to be brought into a stable energy state.

This enables the free energy, ΔG, shown in FIG. 1 to be maintained at a low level, so that the occurrence of sludge can be chemically prevented.

The stabilization of the solution structure is preferably carried out by continuously bringing the entire solution into contact with a porous inorganic material, i.e., by successively and continuously effecting the filtration and circulation of a large volume of a chemical treatment bath.

The reason why the resultant phosphate film becomes dense and has a high quality when using the above-mentioned means is that, since the phosphate (sludge) formed according to a reaction represented by the formula (4) is absent from the chemical treatment bath, the reaction represented by the formula (4) proceeds when iron has been dissolved, i.e., only on the surface of steel (iron) during the chemical treatment, so that no phosphate coating is formed from sludge and the chemical treatment bath has a high capability of forming a phosphate film. For this reason, when steel is brought into contact with the chemical treatment bath, the etching reaction represented by the formulae (1) and (2) sufficiently proceeds. By virtue of a large driving force obtained by the above etching reactions, the film forming reactions represented by the formulae (3) and (4) proceed on the surface of iron steel, and the reaction of the phosphate is precisely conducted on the surface of steel. In particular, in an early stage of the reaction, a very fine crystal is formed on the surface of steel. For this reason, it is believed that the resultant phosphate film is strong and has a high-quality.

The transparent phosphate chemical treatment bath which does not form sludge is such that the transparency of the chemical treatment bath is preferably at least 5 cm, more preferably 20 cm or more.

When the amount of sludge in the chemical treatment bath is reduced to 5 cm or more in terms of the transparency, not only can the above-mentioned problems be solved but also the resultant phosphate coating becomes dense and has a high quality, and the formation of sludge, as such, can be suppressed.

Other various conditions will now be described.

The chemical treatment temperature, i.e., the temperature of the chemical treatment bath, is preferably 40° C. or less, more preferably in the range of from 20° to 35° C. The temperature of the chemical treatment bath and the internal energy, $\Delta H$, of the chemical treatment bath are related to each other. Specifically, the internal energy of the chemical treatment bath increases with an increase in the temperature of the chemical treatment bath. Consequently, the chemical treatment bath becomes unstable, and cannot maintain the whole solution in the liquid state. This functions in such a manner that the internal energy ($\Delta H$) of the liquid is reduced, so that sludge is liable to occur and grow. For this reason, when the temperature of the chemical treatment bath becomes more than 40° C., sludge occurs in the chemical treatment bath, and thus a chemical film having a high quality can not be obtained.

An increase in the internal energy of the chemical treatment bath means that the film forming reaction is accelerated. It is preferred, from the viewpoint of the formation of a film, that the internal energy of the chemical treatment bath be high. Similarly, an increase in the temperature of the chemical treatment bath means that the film forming reaction is accelerated. It is preferred, from the viewpoint of the formation of a film, that the temperature of the chemical treatment bath be high.

On the other hand, when the temperature is less than 20° C., nitrogen oxide, which suppresses the film forming reaction, accumulates in the chemical treatment bath and it becomes difficult for the film formation reaction to proceed.

When the temperature is less than 20° C., it is believed that $N_2O_4$ accumulates in a molecular form in the chemical treatment bath and inhibits the etching of the steel material, so that the formation of a phosphate film is inhibited. $N_2O_4$ is an intermediate product of a reduction reaction of $NO_3^- \rightarrow N_2O_4 \rightarrow NO_2$, and when $N_2O_4$ is present in a large amount, a reaction represented by the formula (1) is inhibited. Since the boiling point of $N_2O_4$ is 21 15° C. when the temperature of the chemical treatment bath is about 20° C. or above, the $N_2O_4$ is present in the form of a gas. In this case, the gas, except for part of the gas dissolved in the treatment bath, vaporizes in the air and is removed from the chemical treatment bath, so that $N_2O$does not accumulate in the chemical treatment bath. On the other hand, when the temperature of the chemical treatment bath is below about 20° C. or less, the $N_2O_4$ is present in the form of a liquid. In this case, it is difficult for the $N_2O_4$ to become a gas and be vaporized. This causes the $N_2O_4$ to be accumulated and inhibits the reaction represented by the formula (1).

Since the chemical treatment bath is usually provided in a room, it is not particularly necessary to heat or cool the chemical treatment bath for maintaining the temperature of the chemical treatment bath at 40° C. or less. A temperature controller may be provided for a closer control of the temperature of the chemical treatment bath at a constant temperature. In the temperature control, however, a rapid heating or rapid cooling changes the liquid chemical-structure of the chemical treatment bath, which unfavorably leads to the formation of sludge.

In the process for a chemical treatment with a phosphate, the redox potential (AgCl electrode potential) of the chemical treatment bath is preferably from 250 to 550 mV, more preferably from 300 to 500 mV.

In the treatment process according to the present invention, since no sludge is contained in the chemical treatment bath, no equilibrium relationship represented by the formula (4) exists, in the sense of the relationship between the soluble-chemical ion contained in the liquid and the solid sludge. In this case, the reaction rapidly proceeds in the right direction on the surface of the steel material, i.e., in the direction of the formation of the phosphate. The reactions represented by the formulae (1) and (2) are each an etching reaction which does not occur without contact of the steel material with the chemical treatment bath. The reaction represented by the formula (3) is a reaction accompanying the reaction represented by the formula (4) and does not occur without the occurrence of the reaction represented by the formula (4). For this reason, an important reaction having an influence mainly on the chemical treatment bath is believed to reside in an equilibrium relationship between the reaction represented by the formula (1) and the reaction represented by the formula (5) (i.e., the reaction represented by the formula (5) supplies $H^+$to the reaction represented by the formula (1)).

When sludge is present, $NO_2^-$ functions in the treatment bath even though no steel material is present in the treatment bath, so that sludge occurs due to the relationship between the reaction represented by the formula (3) and the reaction represented by the formula (4). This causes the amount of the $NO_2^-$ to be reduced. The tendency toward the formation of sludge depends upon the amounts of soluble $Zn^{2+}$ and $Fe^{2+}$ in the chemical treatment bath. Specifically, when the amounts of $Zn^{2+}$ and $Fe^{2+}$ are large, although the treatment bath has a relatively low redox potential, the reaction represented by the formula (4) is accelerated. When no steel material is placed in the treatment bath, the progress of the reaction represented by the formula (4) leads to the progress of the reaction represented by the formula (3), so that the amount of $NO_2^-$ is reduced, and at the same time, the amounts of soluble $Zn^{2+}$ and $Fe^{2+}$ are reduced. This causes the redox potential of the chemical treatment bath to be increased.

It can be considered that the governing reactions in the chemical treatment bath in the absence of sludge are those represented by the formulae (1) and (4). In the process of the present invention, since no sludge is present in the chemical treatment bath, the $NO_2^-$ formed according to the reaction represented by the formula (1) is stably present in the form of $NO_2^-$ or $HNO_2$ in the chemical treatment bath.

Although the reaction represented by the formula (1) is an etching reaction, since it is represented by the formula $NO_3^- \rightarrow NO_2^-$, the concentration of active $NO_3^-$ has a great influence on the redox potential of the chemical treatment bath. Specifically, the oxidizing power of the bath increases with an increase in the $NO_3^-$ concentration of the bath, which contributes to an increase in the capability of the bath to etch the steel material. In this case, the redox potential is relatively high. Besides the etching reaction, the chemical film formation reactions represented by the formulae (3) and (4) are important to the formation of a chemical film. As described above, the chemical film formation reaction is controlled by the reaction represented by the formula (4). In order to facilitate the progress of the reaction represented by the formula (4), soluble $Zn^{2+}$ and $Fe^{2+}$ in the treatment bath should be present in the treatment bath. In this case, the redox potential becomes relatively low. For this reason, the redox potential is preferably from 250 to 550 mV.

$NO_3^-$, which is closely related to the redox potential of the treatment bath, is usually contained together with $H_3PO_4$ and $Zn^{2+}$ in the main agent and supplied as the main agent to the chemical treatment bath. The supply of the main agent to the chemical treatment bath is usually conducted in response to the variation in the conductivity of the chemical treatment bath. In the present invention, however, since the chemical film formation reactions represented by the formulae (1) and (4) are accurately controlled, it is also possible to supply the main agent when the oxidation-reduction potential has lowered. That the redox potential of the chemical treatment bath can be controlled by controlling the supply of the main agent means that the redox potential reflects the whole balance between the oxidation-reaction and the reduction-reaction in the bath.

The redox potential of the chemical treatment bath in the process for chemical treatment with a phosphate according to the present invention is from 250 to 550 mV (AgCl electrode potential). Both an excessively high redox potential and an excessively low redox potential are unfavorable for the formation of a strong phosphate film.

The redox potential of the chemical treatment bath is deemed to reflect the reaction represented by the formula (4) as a typical example among various equilibrium systems in the treatment bath. Specifically, when the amount of soluble metal ions is large, the redox potential becomes low. On the other hand, when the amount of soluble metal ions is small, the redox potential becomes high. For this reason, when the redox potential is more than 550 mV, since the amount of soluble metal ions (particularly $Fe^{2+}$) in the bath becomes small, the reaction represented by the formula (4) is inhibited in the treatment bath, so that it becomes impossible to form a film.

On the other hand, when the redox potential is less than 250 mV, the amount of soluble metal ions becomes large, which facilitates the formation of sludge in the treatment bath, so that it becomes difficult to maintain the transparency of the chemical treatment bath. This makes it impossible to form a strong chemical film.

In the chemical film treatment bath according to the present invention, the concentrations of the phosphate ion, the film forming metal ion and the nitrate ion are preferably about 4 g/liter or more, about 1.5 g/liter or more and about 3 g/liter or more, respectively. The upper limits of concentration of the phosphate ion, the film forming metal ion and the nitrate ion are about 100 g/liter, about 20 g/liter and about 150 g/liter, respectively. The most preferred ion concentration is from about 5 to 30 g/liter for the phosphate ion, from about 1.5 to 5 g/liter for the film forming metal ion, and from about 3 to 30 g/liter, respectively.

The control of the chemical treatment bath is basically carried out by controlling the redox potential. In order to accurately control the chemical treatment bath, the control of a combination of the chemical treatment bath with hydrogen ion concentration (pH) and electric conductivity (EC) is conducted.

A pH (i.e., hydrogen ion concentration) is preferably from about 1.5 to 4.5. When the pH is lower than 1.5, it becomes difficult to advance the film forming reactions represented by the formulae (3) and (4). On the other hand, when the pH exceeds 4.5, it becomes difficult to continuously conduct the etching reactions represented by the formulae (1) and (2). The pH can be high by adding a neutralizer, such as caustic soda, and can be lowered by adding the main agent.

The proper range of the electric conductivity of the chemical treatment bath varies depending upon the kind of the chemical treatment bath. Specifically, in the case of a bath having a high content of an active ion, such as nitrate ion, the electric conductivity is set to a relatively high value, and in the case of a bath having a low content of nitrate ion or the like and a high content of phosphate ion, the electric conductivity is set to a relatively low value. In general, the main agent is added in the lower limit of the set value of the electric conductivity, and the electric conductivity of the chemical treatment bath is controlled to a given range. The electric conductivity is varied depending upon the chemical-ion structure in the chemical treatment bath, and the electric conductivity is lowered with the advance of the structuring of ions in the solution even in the same composition. The electric conductivity of the chemical treatment bath is controlled to from 10 to 200 $mS.cm^{-1}$ by taking into consideration the above-mentioned facts.

As described above, in the process for a chemical treatment with a phosphate according to the present invention, the temperature and redox potential of the chemical treatment bath is maintained at 40° C. or less and 250 to 550 mV, respectively, in the absence of sludge in the chemical treatment bath, and other chemicals and treatment steps such as degreasing of the steel material necessary for the phosphate chemical treatment process are the s&me as those used in the conventional phosphate chemical treatment process.

In the phosphate chemical treatment process according to the present invention, since the sludge is substantially absent form the chemical treatment bath, no sludge is included in the resultant phosphate film. Further, the amount of components which inhibit the film forming reaction in the chemical treatment bath is so small that a strong phosphate film is formed on the surface of the steel material, so that the resultant phosphate film has a high quality.

Further, since sludge is less liable to form in the chemical treatment bath, there is little possibility that the chemical will be consumed as sludge, so that wastage of the chemical is reduced. This contributes to an enhancement in the utilization of the chemical.

Further, the control of the chemical treatment bath can be conducted by substantially merely controlling the adding of the main agent and the neutralizer in response to the variation in the redox-potential electric conductivity and pH, so that the control of the chemical treatment bath is remarkably simplified.

EXAMPLE

The present invention will now be further illustrated by, but is by no means limited to, the following Examples.

A chemical treatment with a phosphate was carried out under treatment conditions specified in Table 1 through the use of a 1 $m^3$ chemical treatment bath 1 comprising, in weight proportions, 2 g/liter of $Zn^{2+}$, 5 g/liter of $H_3PO_4$, 16 to 20 g/liter of $NO_3^-$, 0.5 g/liter of $Ni^{2+}$and 0.1 g/liter of $F^-$. Steel magnet clutch parts (surface area: 2.5 $dm^2$/clutch) for automobile components were used as a material to be treated, i.e., a work piece 10, and 60 clutch parts were suspended per hanger 12 and treated. Subsequent to the phosphate chemical treatment, a cationic electrodeposition coating was conducted. To evaluate the properties of the phosphate chemical film, in one case, only the phosphate chemical treatment was conducted with the paint coating being omitted. The steps were conducted in the following sequence: degreasing→degreasing→washing with water→adjustment of surface→phosphate chemical treatment→washing with water→washing with pure water→cationic electrodeposition coating→washing with pure water→washing with pure water→washing with pure water→setting→baking (195° C. 30 min) In each step, the tact time was 2 min. In washing with water of the phosphate chemical treatment after the degreasing, fresh industrial water was sprayed after washing with water so that washing with water could be properly carried out.

Figure 2:
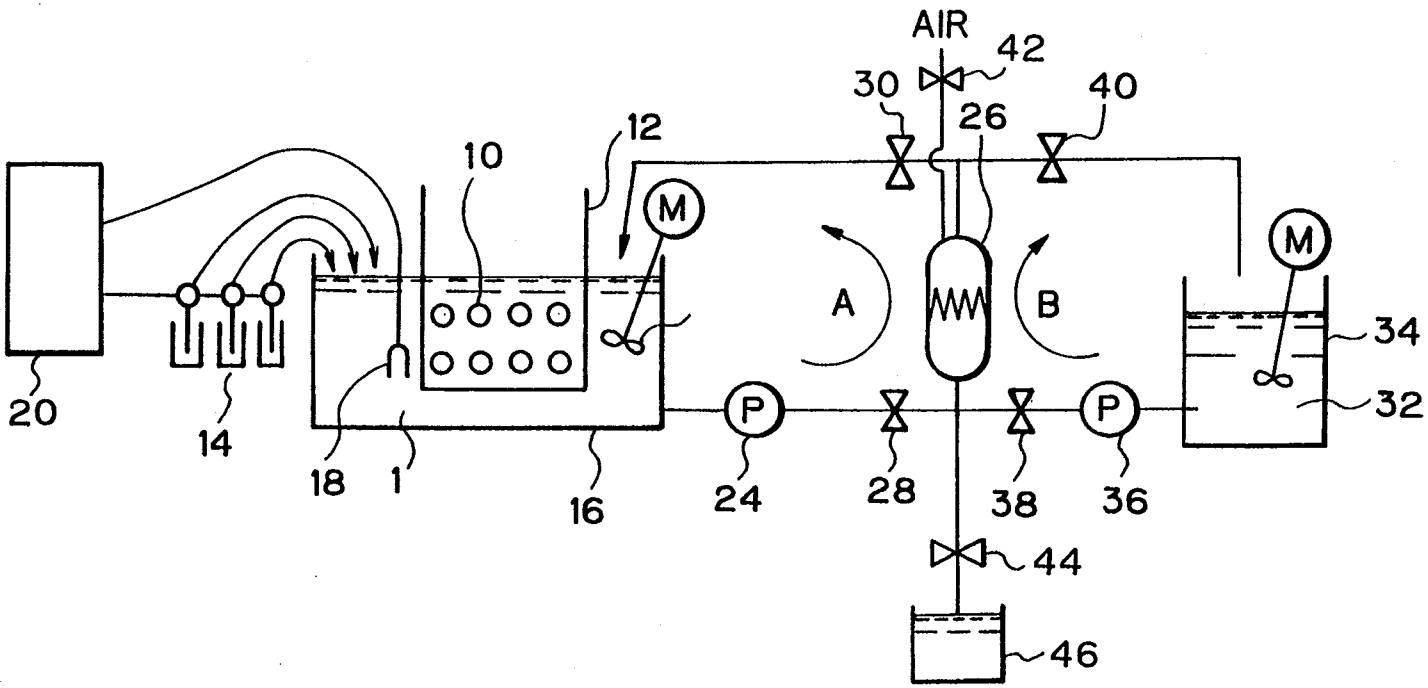
FIG. 2 is a schematic view of a system used in the first Example.

An apparatus used in the first Example is schematically shown in FIG. 2.

The work piece 10 is suspended by a hanger 12 and immersed in the phosphate chemical treatment bath 1 of the present invention. In order to maintain the pH and redox potential of the chemical composition of the phosphate chemical treatment bath respectively at predetermined values also during the reaction, a main agent and other assistant agents are placed in a subtank 14, and piping is provided so that the chemicals can be introduced from the sub-tank 14 into a vessel 16 filled with the phosphate chemical treatment bath 1. The amounts added of the main agent and other assistant agents are determined by judging a signal from a sensor 18 provided in the bath 1 by a controller 20. In the bath 1, an agitator 22, the number of revolutions of which are maintained constant, is provided so that the chemical composition of the bath 1 is maintained constant.

Furthermore, the vessel 16 is provided with another piping. Specifically, a filtration circulation path A is provided for withdrawing a portion of the phosphate chemical treatment bath 1 in the vessel 16 and returning it to the vessel 16. The path A is provided with a pump 24 for circulating the phosphate chemical treatment bath 1 through the path A, a filter 26 as stabilization means for stabilizing the energy state of the phosphate chemical treatment bath 1 and valves 28 and 30.

Further, a precoat path B is formed in the filter 26 for forming a diatomaceous earth coating constituting the surface of the filter 26 The precoat path B is provided with a precoat vessel 34 containing a diatomaceous-earth-containing coat solution 32, a pump 36 for conducting a circulation through the precoat path B, a filter 26, and valves 38 and 40.

During the formation of a usual coating, the valves 28 and 30 were opened and the valves 38 and 40 were closed, to circulate the phosphate chemical treatment bath 1 through the circulation filtration path A. This circulation enabled the bath 1 in the vessel 16 to be agitated and the phosphate chemical treatment bath 1 to be passed through the filter 26, so that not only was the sludge in the bath 1 removed but also the energy of the bath 1 was stabilized.

When the coating of diatomaceous earth became necessary due to a deterioration or other phenomenon of the diatomaceous earth on the surface of the filter 26, the valves 28, 30, 38 and 40 were closed and the valves 42 and 44 opened. And a high pressure air was supplied to a filtration filter 26, whereby the deteriorated diatomaceous earth was withdrawn, together with the treatment bath remained in the filter 26, to a vessel 46. The treatment bath containing the diatomaceous earth withdrawn in the vessel 46 was separated by a dewatering filtration device (not shown in the drawing) to the diatomaceous earth and the clear treatment bath. The separated clear treatment bath was introduced into the vessel 34 for the reutilization. The separated diatomaceous earth was wasted. Thereafter, the valves 28, 30, 42 and 44 were closed and the valves 38 and 40 were opened. Thus, the coating solution 32 was circulated through the precoat path B. Thus, the diatomaceous earth was coated on the surface of the filter 26 by the circulation of the coating solution 32.

Thus, with respect to the control of the chemical treatment bath, in the conventional example shown in Table 1, the phosphate chemical treatment was carried out in the presence of sludge without effecting the filtration of the chemical treatment bath. The control of the treatment bath was carried out by a method described in Japanese Unexamined Patent Publication (Kokai) No. 63-270478. In the comparative example and examples shown in Table 1, the chemical treatment bath was filtered by means of diatomaceous earth to maintain the transparency of the chemical treatment bath at a value higher than that shown in Table 1. The pressure loss caused by the filtration and the amount of circulation by filtration were maintained respectively at 0.4 to 0.6 $kg/cm^2$ and 3 to 10 $m^3$ per hour, respectively, by controlling the filtration pump rotation.

TABLE 1

Figure 3:
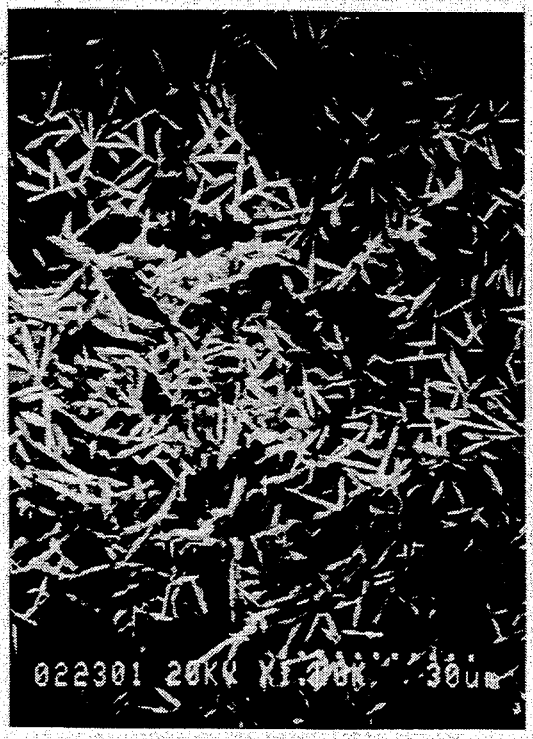
FIG. 3 is an SEM photograph of a crystal structure of a phosphate coating obtained in Example 1.
Figure 4:
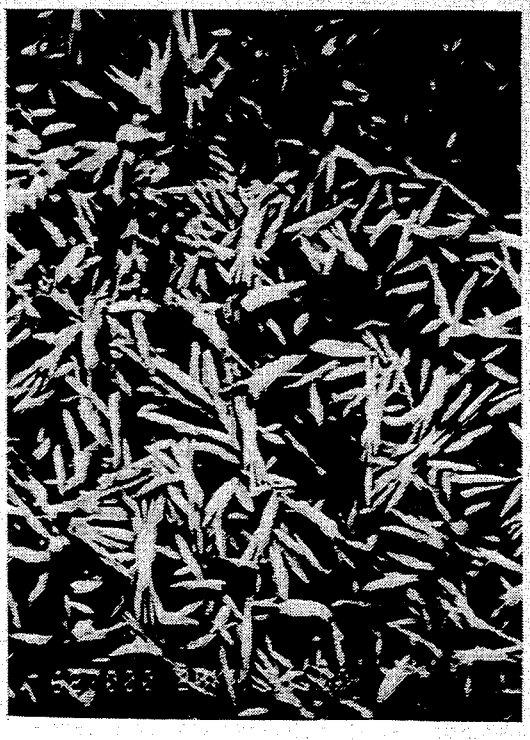
FIG. 4 is an SEM photograph of a crystal structure of a phosphate coating obtained in Example 2.
Figure 5:
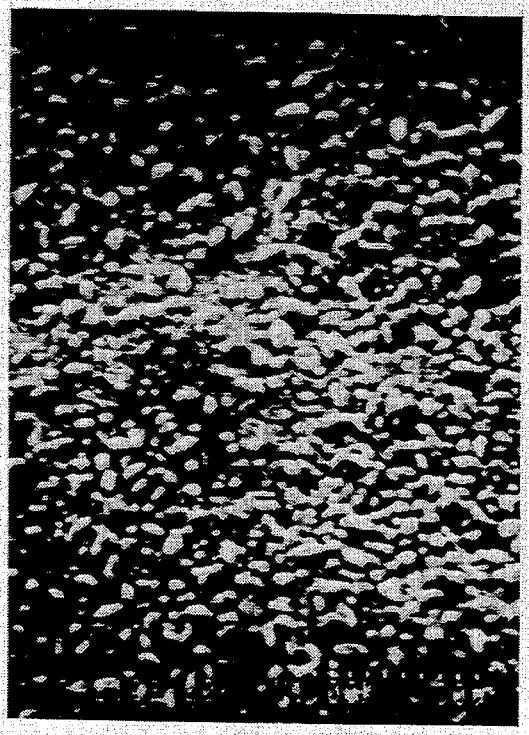
FIG. 5 is an SEM photograph of a crystal structure of a phosphate coating obtained in Example 3.
Figure 6:
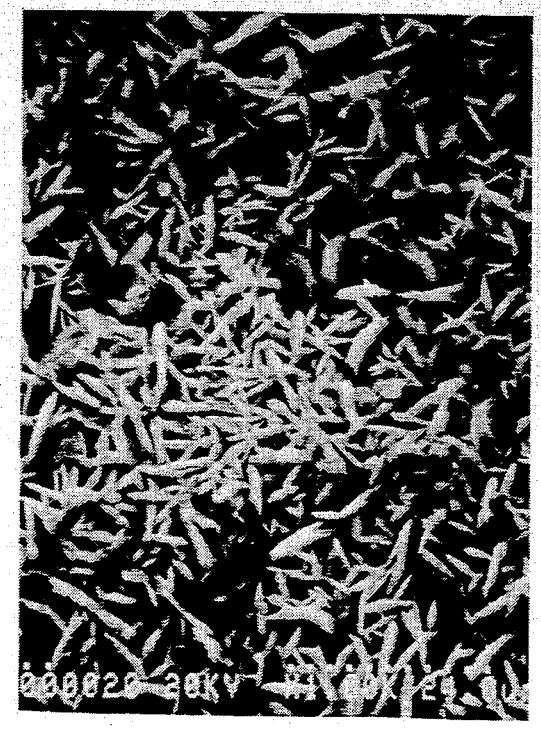
FIG. 6 is an SEM photograph of a crystal structure of a phosphate coating obtained in the Comparative Example.
Figure 7:
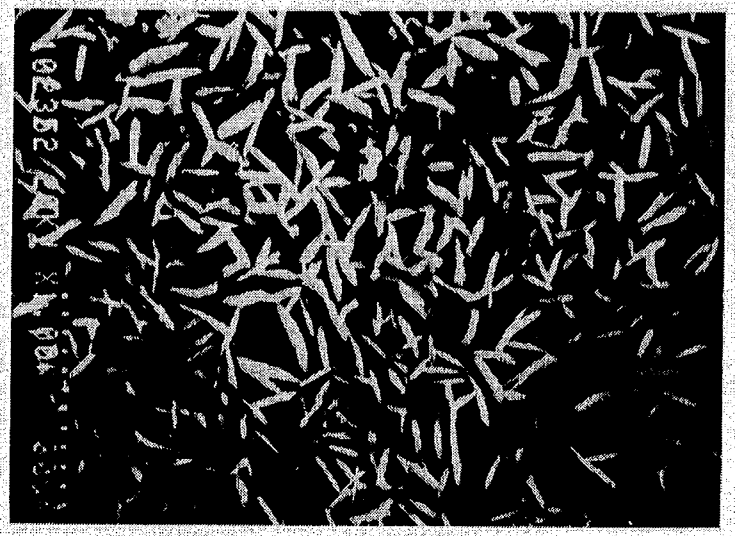
FIG. 7 is an SEM photograph of a crystal structure of a phosphate coating obtained in the conventional method.

| Sample | Filtration Yes or No | Transparency (cm) | Electric conductivity (mS/cm) upper limit lower limit | pH upper limit lower limit | Redox potential upper limit lower limit (mV) | Treatment bath temp. (°C.) | Total acid content (pt) | Free acid content (pt) | Photograph (Fig.) | Peeling (width) (mm) |
|---|---|---|---|---|---|---|---|---|---|---|
| Example 1 | Yes | 30 or more | 49.0<br>48.0 | 2.70<br>2.60 | 545<br>510 | 20.6 | 24.4 | 2.6 | FIG. 3 | 1.0 |
| Example 2 | Yes | 30 or more | 45.0<br>40.0 | 3.05<br>2.95 | 480<br>460 | 26.6 | 15.8 | 1.6 | FIG. 4 | 0.0 |
| Example 3 | Yes | 30 or more | 31.0<br>28.0 | 3.00<br>2.90 | 350<br>300 | 25.5 | 9.0 | 1.5 | FIG. 5 | 0.0 |
| Comp. Example | Yes | 30 or more | 45.0<br>40.0 | 3.20<br>3.10 | 487<br>400 | 17.6 | 19.6 | 0.8 | FIG. 6 | 4–10 |
| Conventional Example | No | 3–5 | 50.0<br>45.0 | 3.30<br>3.10 | 460<br>450 | 25.0 | 18–20 | 0.4 | FIG. 7 | 5–9 |

The chemical treatment bath was controlled by the redox potential, pH and electric conductivity shown in Table 1. NAN02 was supplied as an accelerator when the redox potential reached the lower limit shown in Table 1. When the pH reached the lower limit, caustic soda or the like was supplied as a neutralizer, and when the pH reached the upper limit, an acidic solution wherein the concentrations of chemical components had been increased in the chemical treatment bath was supplied as the main agent. When the electric conductivity reached the upper limit, no main agent was supplied even when the pH reached the upper limit. When the electric conductivity reached the lower limit, the main agent was supplied.

The temperature of the chemical treating bath was not particularly controlled and was from 20°0 to 27° C.

The SEM photographs (×1000) of the resultant phosphate chemical films are shown in FIGS. 3 to 7. In the painting, a coating having a thickness of 20 to 25 μm was formed. In order to examine the corrosion resistance of the resultant phosphate chemical film, a linear cutout was provided by means of a knife on the painted surface of the coating, and the coating was then immersed in an aqueous 5% NaCl solution of 55° C. for 240 hr and dried. A pressure-sensitive adhesive tape was pressed on the cutout portion, and then peeled off to measure the size of the peeled coating adhered to the tape. The size of the peeling is a measure of the corrosion resistance of the phosphate chemical film. The smaller the width of peeling, the better the corrosion resistance.

No significant differences were observed between the phosphate chemical films, as can be seen from the SEM photographs. In a salt water immersion test, samples of Examples 1 to 3 subjected to treatment according to the phosphate chemical treatment process of the present invention exhibited very good results, i.e., a peeling width of 0 to 1.0 mm. On the other hand, the peeling width was as large as 5 to 9 mm for the Conventional Example, and as large as 4 to 10 mm for the Comparative Example.

I claim:

1. A process for forming a phosphate chemical treatment film on a surface of a steel material by bringing the steel material into contact with a phosphate chemical treatment bath containing a phosphate ion, a nitrate ion, a chemical coating formable metal ion and an oxidizing agent to cause a film formation reaction between the phosphate chemical treatment bath and the surface of the steel material, wherein:

a portion of the phosphate chemical treatment bath is circulated through a circulating path provided therein with a filter comprising an inorganic material composed mainly of $SiO_2$ and $Al_2O_3$ by withdrawing the portion of the phosphate chemical treatment bath from a bath vessel and returning the same to the bath vessel, the circulating phosphate chemical treatment bath is filtered through the filter; and a thermodynamic energy balance in the solution of the above-mentioned chemical component in the phosphate chemical treatment bath, which governs the thermodynamic condition as a liquid of the phosphate chemical treatment bath, is controlled and stabilized to prevent the formation of solids from the chemical components contained in the phosphate chemical treatment bath.

2. A process as claimed in claim 1, wherein:

the filtration of the phosphate chemical treatment bath and the stabilization of the phosphate chemical treatment bath are effected by providing the filter comprising porous inorganic materials composed mainly of $SiO_2$ and $Al_2O_3$, whereby solids contained in the phosphate chemical treatment bath are removed by filtration, and an unstable energy condition caused by a very small chemical-structural distortion caused between the ions of the chemical components dissolved in the phosphate chemical treatment bath is converted to a solution-structurally stable energy condition by a solution-chemical interaction between the phosphate chemical treatment bath and the surfaces of $SiO_2$ and $Al_2O_3$.

3. A process as claimed in claim 2, wherein a pumping means is provided to circulate the portion of the phosphate chemical treatment bath and to control the applied pressure to the circulating phosphate chemical treatment bath, whereby the phosphate chemical treatment bath is thermodynamically stabilized.

4. A process as claimed in claim 3, wherein the pressure applied to the circulating phosphate chemical treatment bath by the pumping means is more than 0 $kg/cm^2$, but not more than 1.0 $kg/cm^2G$.

5. A process as claimed in claim 4, wherein:

variation values of a pH, an electric conductivity, and a redox conductivity (AgCl electrode potential) of the phosphate chemical treatment bath are determined and;

a phosphate ion, a nitrate ion, a chemical coating formable metal ion, and an oxidizing agent are added to the phosphate chemical treatment bath, corresponding to the detected variation values.

6. A process as claimed in claim 5, wherein the filter comprising a porous inorganic material composed mainly of $SiO_2$ and $Al_2O_3$ is composed of diatomaceous earth.

7. A process as claimed in claim 6, wherein the phosphate chemical treatment bath is maintained in the range of a pH of 1.5–4.5, an electric conductivity of 10–200 $mS.cm^{-1}$ and a redox conductivity of 250–550 mV.

8. A process as claimed in claim 7, wherein the temperature of the phosphate chemical treatment bath is maintained at a temperature of 20° C. to 40° C. to thermodynamically stabilize the phosphate chemical treatment bath.

9. An apparatus for forming a phosphate chemical treatment film on a surface of a steel material comprising:

(i) a phosphate chemical treatment bath vessel receiving a phosphate chemical treatment bath containing a phosphate ion, a nitrate ion, a chemical coating formable metal ion and an oxidizing agent;

(ii) a circulating path for withdrawing a portion of the phosphate chemical treatment bath and returning the withdrawn phosphate chemical treatment bath to the bath vessel;

(iii) a circulating means for continuously circulating a portion of the phosphate chemical treatment bath through the circulating path;

(iv) a filter means for filtering the phosphate chemical treatment bath, provided in the circulating path; and (v) a stabilizing means for controlling and stabilizing a thermodynamic energy balance in the solution of the above-mentioned chemical component in the phosphate chemical treatment bath, which governs the thermodynamic condition as a liquid of the phosphate chemical treatment bath.

10. An apparatus as claimed in claim 9, wherein the filter means and the stabilizing means are a filter comprising an integrally formed porous inorganic material composed mainly of $SiO_2$ and $Al_2O_3$, whereby the phosphate chemical treatment bath is purified by filtration and an unstable energy condition caused by a very small chemical-structural distortion caused between the ions of the chemical components dissolved in the phosphate chemical treatment bath is converted to a solution-structurally stable energy conditions by a solution-chemical interaction between the phosphate chemical treatment bath and the surfaces of $SiO_2$ and $Al_2O_3$.

11. An apparatus as claimed in claim 10, wherein the circulating means is a pump which applies a pressure of 1.0 $kg/cm^2$ or less to the phosphate chemical treatment bath in the circulating bath.

12. An apparatus as claimed in claim 11, wherein the stabilizing means further comprises:

a detecting means for detecting variations of a pH, an electric conductivity, and a redox conductivity (AgCl electrode potential) of the phosphate chemical treatment; and an addition means for adding a phosphate ion, a nitrate ion, a chemical coating formable metal ion, and an oxidizing agent to the phosphate chemical treatment bath, corresponding to the detected variation values.

13. An apparatus as claimed in claim 12, wherein the filter comprising a porous inorganic material composed mainly of $SiO_2$ and $Al_2O_3$ is composed of diatomaceous earth.

14. An apparatus as claimed in claim 13, wherein the phosphate chemical treatment bath is maintained in the range of a pH of 1.5–4.5, an electric conductivity of 10–200 $mS.cm^{-1}$ and a redox conductivity of 250–550 mV.

15. An apparatus as claimed in claim 14, wherein the apparatus further comprises a heating means for indirectly heating the phosphate chemical treatment bath to maintain the temperature of the phosphate chemical treatment bath at 20°–40° C.

* * * * *